US005626450A

United States Patent [19]

Ferrari et al.

[11] Patent Number: 5,626,450

[45] Date of Patent: May 6, 1997

[54] EXPANSION PLUG FASTENING ASSEMBLY WITH POSITION ADJUSTMENT FOR HARDWARE ELEMENTS IN PARTICULAR FOR RUNNERS FOR DRAWERS

[75] Inventors: Franco Ferrari, Frazione Deviscio, 2, 22053 Lecco; Carlo Migli, Lecco, both of Italy

[73] Assignee: Franco Ferrari, Lecco, Italy

[21] Appl. No.: 450,690

[22] Filed: May 25, 1995

[30] Foreign Application Priority Data

Jun. 21, 1994 [IT] Italy ..... MI94U0451

[51] Int. Cl.[6] ..... F16B 19/00

[52] U.S. Cl. ..... 411/510; 411/180; 411/553; 411/549

[58] Field of Search ..... 411/508, 509, 411/510, 539, 540, 180, 169

[56] References Cited

U.S. PATENT DOCUMENTS

| | | | |
|---|---|---|---|
| 3,486,158 | 12/1969 | Soltysik et al. | 411/510 |
| 3,701,373 | 10/1972 | Wronke et al. | 411/182 |
| 4,478,545 | 10/1984 | Mizusawa et al. | 411/182 |
| 4,756,654 | 7/1988 | Clough | 411/512 |
| 4,904,110 | 2/1990 | Klein | 411/169 |
| 5,090,797 | 2/1992 | Harley | 312/348 |
| 5,468,109 | 11/1995 | Ferrari et al. | 411/180 |

FOREIGN PATENT DOCUMENTS

| | | | |
|---|---|---|---|
| 0006050 | of 1888 | United Kingdom | 411/169 |
| 0745788 | 2/1956 | United Kingdom | 411/508 |
| 1593545 | 7/1981 | United Kingdom | 411/169 |

*Primary Examiner*—Lloyd A. Gall
*Assistant Examiner*—Fredrick Conley
*Attorney, Agent, or Firm*—Shlesinger Fitzsimmons Shlesinger

[57] ABSTRACT

An expansion plug fastening assembly (15, 115) for fastening a hardware element (13, 113), in particular a runner for drawers, to a hole (11, 111), comprises an expansion plug casing (10, 110) which fits into the hole. The casing (10, 110) comprises an axial housing (16, 17, 116, 117) axially rotatably housing the shank (24, 25, 124, 125) of a pin (22, 122) for fastening the hardware element. At least one first segment of the shank (25, 125) has an axis (23) eccentric with respect to the head (18, 118) to permit adjustment of the position of the hardware element in a plane perpendicular to the axis of the pin on rotation of the pin. The shank advantageously also comprises a second segment (24, 124) coaxial to the head and the housing comprising a first (17, 117) and a second portion (16, 116) receiving the first (25, 125) and the second segment (24, 124) respectively. The first portion and second portion being extended in two orthogonal directions radial to the casing of the expansion plug so that, upon rotation of the pin, each segment (24, 25, 124, 125) moves in the direction of extension of its respective portion of the housing.

7 Claims, 2 Drawing Sheets

EXPANSION PLUG FASTENING ASSEMBLY WITH POSITION ADJUSTMENT FOR HARDWARE ELEMENTS IN PARTICULAR FOR RUNNERS FOR DRAWERS

BACKGROUND OF THE INVENTION

This invention refers to an expansion plug-type fastening assembly for adjustably fastening in place furniture hardware elements such as for example runners for drawers. In the known technique, hardware elements for furniture units are generally secured directly to the walls of the furniture by means of screws or by inserting ordinary pressure or expansion plugs.

These known fastening means have the drawback of rigidly restricting the position of the hardware element to the furniture unit. Whenever adjustment is required, for example in order to remedy inevitable manufacturing tolerances, it has been proposed to use hardware elements comprising movable adjusting parts in their structure, such as intermediate plates placed between the actual element itself and fastening screws or expansion plugs.

In various cases however, in order to limit the costs of the hardware element or due to dimensional problems, it is not possible to make use of such adjusting structures.

For example, runners for drawers have very limited thicknesses since they have to be totally contained in the interspace between the side of the drawer and the corresponding side panel of the piece of furniture.

Consequently, it is not possible to insert adjusting structures, since even the head of the fastening screw must be contained within the thickness of the metal forming the runner itself. Any error in positioning the runner thus results in an irreparable faulty vertical spacing of the front walls of the drawers. In addition to being unsightly, whenever it is of a considerable extent this faulty alignment can cause defective sliding and reciprocal interference between the drawers.

The general scope of this invention is to obviate the aforementioned problems by providing an extremely compact expansion plug fastening assembly for hardware elements, such as runners for drawers, which permits quick and easy adjustment of the position of the fixed element.

SUMMARY OF THE INVENTION

This scope is achieved according to the invention by providing an expansion plug fastening assembly for fastening a hardware element, in particular a runner for drawers, to a hole in a surface, comprising an expansion plug casing which fits into the hole, the casing internally comprising an axial housing axially rotatably housing the shank of a pin, the pin having a head facing out from the housing for fastening the hardware element, at least one first segment of the shank having an axis eccentric with respect to the head to permit adjustment of the position of the hardware element in a plane perpendicular to the axis of the pin on rotation of the pin.

BRIEF DESCRIPTION OF THE DRAWINGS

The innovative principles of this invention and its advantages with respect to the known technique will be more clearly evident from the following description of several possible exemplificative embodiments applying such principles, with reference to the accompanying drawings, in which.

DETAILED DESCRIPTION OF THE INVENTION

Figure 1:
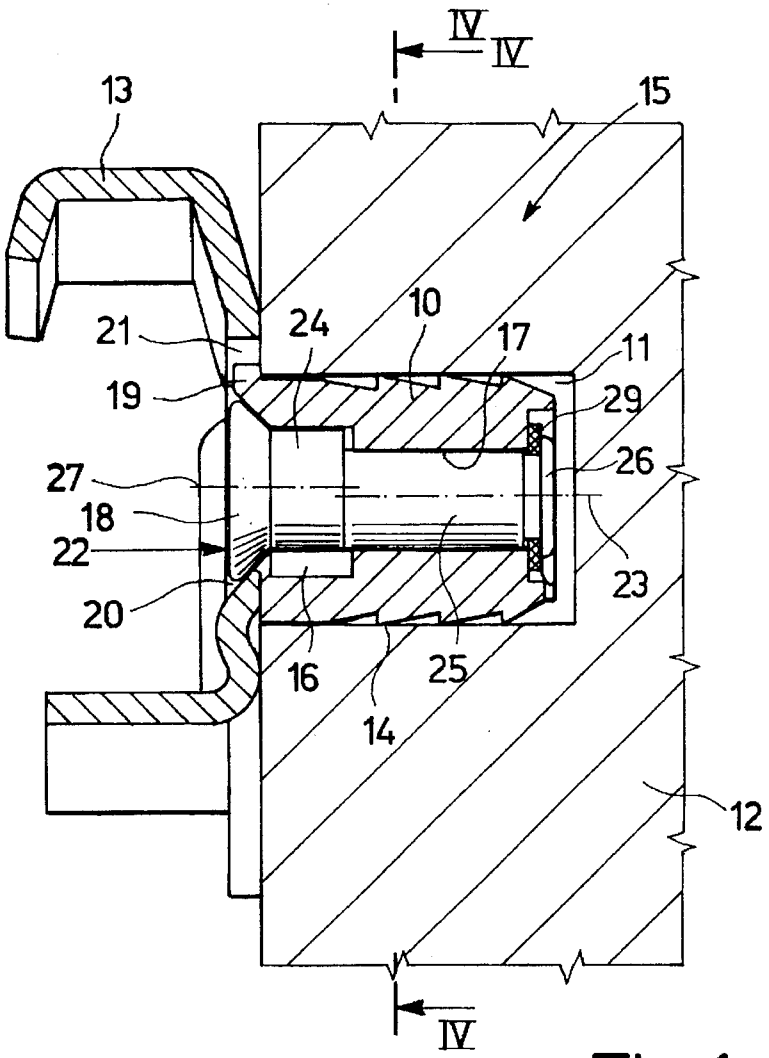
FIG. 1 shows a partial longitudinal cross-sectional view along the line I—I of FIG. 2, of a fastening assembly according to the invention.

With reference to the figures, FIG. 1 shows an expansion plug-type fastening assembly, generically indicated by reference 15, for fastening a hardware element 13, in particular a runner for drawers, in a hole 11 in a surface of a furniture unit 12.

The fastening assembly comprises a cylindrical expansion plug casing 10 made of pliable material, for example moulded from plastic, to fit by pressure into the hole 11. The casing 10 advantageously has circumferential ribs 14 tapering towards the inside of the hole to constitute a constraint against its re-extraction.

The casing 10 internally comprises an axial housing in the form of registering openings 16, 17 receiving the shank segments 24, 25 of a pin 22 so that the pin is axially rotatable. The pin has a head 18 which faces out frontally from the housing for fastening the hardware element. Advantageously, the head is made countersunk to be received in a correspondingly countersunk hole 20 in the thickness of the metal of the hardware element.

To prevent the pin from slipping out of the housing 16, 17, the housing in the expansion plug is a through housing and the pin finishes at its tail end with a riveted portion 26 to imprison a lock washer 29.

According to the invention, the pin 22 has at least one first shank segment 25 with an axis 23 eccentric with respect to the head 18.

Thus, by rotating the pin, for example by means of a screwdriver engaging in a corresponding slot in the head (shown in FIG. 2), the position of the hardware element can be quickly and easily adjusted in a plane perpendicular to the axis of the pin.

To ensure greater precision in adjustment, the shank of the pin also comprises intermediate its ends a second segment 24, advantageously close to the head 18, which is coaxial to the head 18 according to the axis 27. Accordingly, the housing in the expansion plug is divided into a first portion 17 which receives the first cylindrical segment 25 and a second portion 16 which receives the second cylindrical segment 24. As can be clearly seen in FIG. 3, which shows just the casing of the expansion plug from its front end from which the head of the pin protrudes, the first portion 17 of the housing which is slightly oval in cross-sectional configuration, is extended in a first direction radial to the axis of expansion plug casing 10, while the second portion 16 of the housing which also is slightly oval in cross-sectional configuration, is extended in a second direction, also radial to the casing 10 of the expansion plug, which is directed perpendicular to the direction of extension of the first portion of the housing.

In this way, upon rotation of the pin, each segment of the pin is guided by and is therefore forced to move in the direction of extension of its respective portion of the housing, thereby achieving a cam movement effect which forces the head of the pin to move at right angles to the axis of the pin with rectilinear motion along the extension of the housing portion 16, and thus constituting means for guiding the movement of the head.

Figure 3:
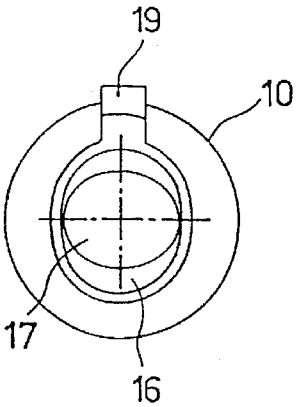
FIG. 3 shows a front view of an expansion plug element of the assembly of FIG. 1.

As can also be seen in FIG. 3, advantageously, the first portion 17 of the housing has a cross-section inscribed in the cross-section of the second portion 16 of the housing and has a major crosswise dimension which is substantially identical to the minor crosswise dimension of the second portion, the two portions of the housing also having identical eccentricity.

Figure 4:
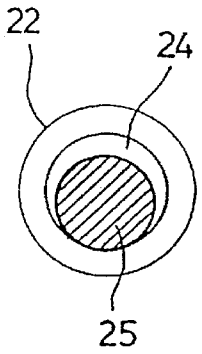
FIG. 4 shows a cross-sectional view along the line IV—IV of FIG. 1, of a pin element of the assembly.

Correspondingly, as shown in FIG. 4, the first segment 25 of the pin is inscribed with its cross-section within the cross-section of the second segment 24 and tangent thereto. The diameters of the two sections of the pin are slightly smaller than the minor crosswise dimensions of the respective portions of the housing, so as to slide within them in the direction of extension.

Figure 2:
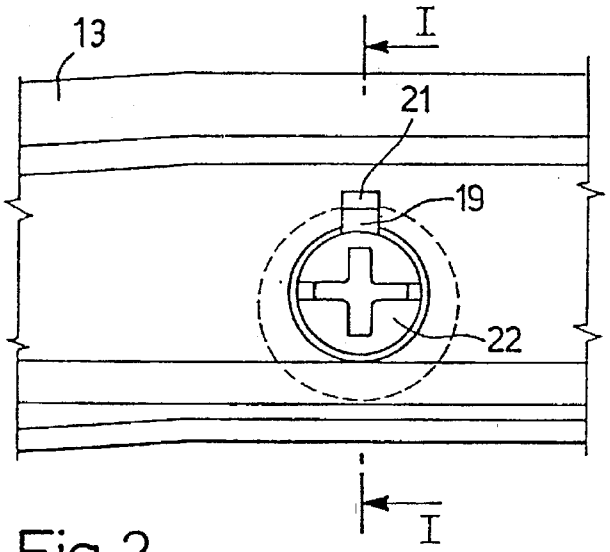
FIG. 2 shows a front view of the assembly of FIG. 1.

As can be clearly seen in FIGS. 1–3, the expansion plug casing 10 can advantageously comprise a tooth 19 protruding therefrom close to the head of the pin so as to fit into a corresponding slot 21 made in the hardware element 13 on the edge of its hole 20, so as to constitute a constraint which prevents axial rotation of the expansion plug with respect to the hardware element when the pin is rotated.

Figure 5:
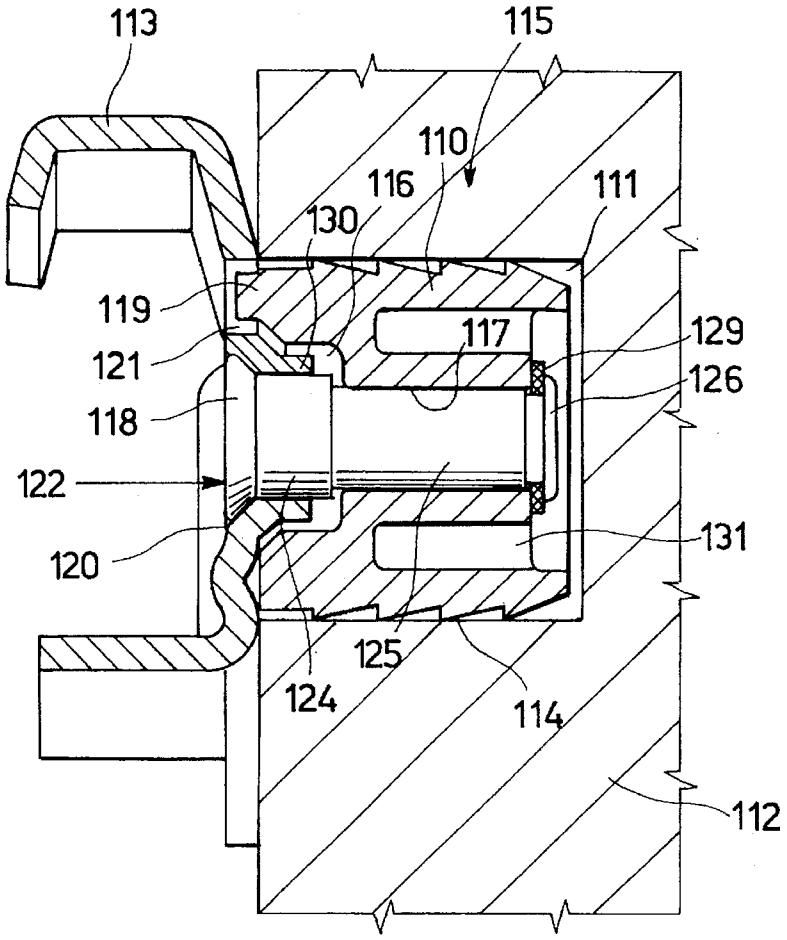
FIG. 5 shows a view similar to that of FIG. 1, but of an alternative embodiment of an assembly according to the invention.

FIG. 5 shows a possible variation of the embodiment of the coupling assembly according to the invention. To facilitate the description, elements of the embodiment of FIG. 5 similar to elements of the embodiment of FIG. 1 will be indicated with the same numbering as FIG. 1 increased by 100.

Hence, a fastening assembly 115 for fastening a hardware element 113, in particular a runner for drawers, comprises an expansion plug casing 110 made of pliable material, with tapered circumferential ribs 114 which fits by pressure into a hole 111 in a surface of a furniture unit 112.

The casing 110 comprises an axial housing 116, 117 receiving the shank 124, 125 of a pin 122, which has a lock washer 129 secured to one riveted end 126. The pin has a countersunk head to restrain the hardware element and is axially rotatable. FIG. 5 shows the pin in its intermediate adjusting position. It is of the same assymetrical shape as the pin shown in FIG. 1. In fact, as in the case of the previous embodiment, the pin 122 has a first segment 125 which is eccentric with respect to the head, in order to adjust the position by rotating the pin. The shank also comprises a second segment 124 close to and coaxial to the head which is received in a portion 116 of the housing in the expansion plug. In this second embodiment, inserted between the segment 124 and the side wall of the portion 116 of the housing is an edge 130 drawn by the edge 120 of the hardware element. Apart from their different size, the two portions of the pin housing have an elongated shape similar to the embodiment of FIG. 3. In this way, upon rotation of the pin each segment of the pin is forced to move in the direction of extension of its respective portion of the housing.

The casing 110 has a detent 119 to prevent rotation which protrudes to fit into a corresponding hole 121 extending in the direction of movement of the head 118.

To acquire greater lateral elasticity of the casing during its coupling in the hole, the casing is made with a slot 131 disposed around and parallel to the pin housing which opens out at the rear end of the expansion plug.

At this point it will be clear that the intended scopes have been achieved by providing an expansion plug-type fastening device which allows hardware elements to be easily adjusted in position.

Figure 6:
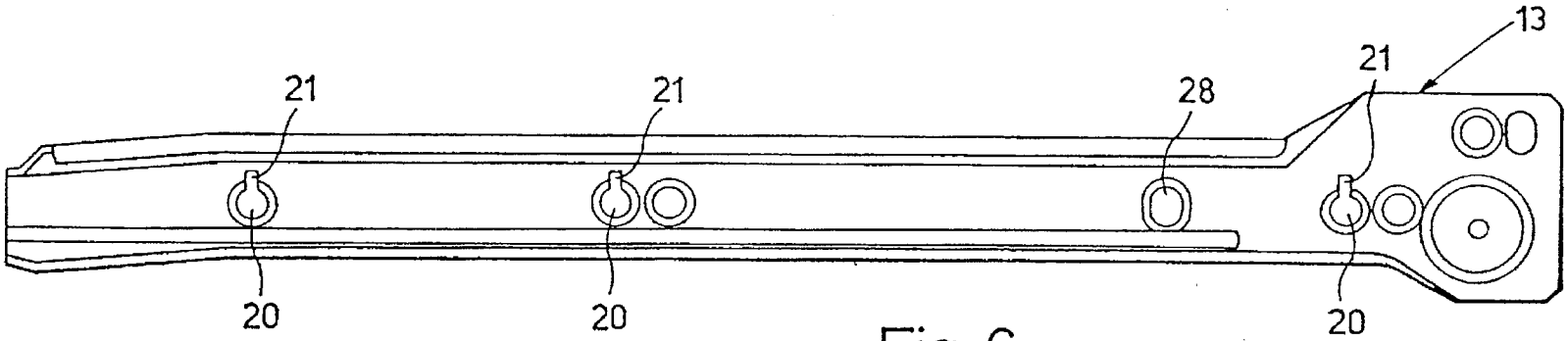
FIG. 6 shows a view of a portion of a runner for drawers particularly suitable for use with the fastening assembly according to the invention.

FIG. 6 shows a runner 13 (not further described or shown, since the remainder is of known technique) advantageously adapted with three holes 20 to receive, for example, the fastening assemblies of FIG. 1.

The expansion plugs can have the dual function of retaining and adjusting or adjusting alone. For example, in the first case the ribs 14, 114 are of such dimensions as to fit with good interference in the respective hole in the furniture unit. In the second case the ribs 14, 114 can be of such size as to prevent clearance in the hole but not necessarily to prevent easy re-extraction of the expansion plug, thus constituting only a restraint against transversal movement.

Whenever it is not considered necessary to maintain parallelism of the runner during adjustment, it can also be envisaged to use an expansion plug according to the invention, for one of the end holes of the runner and a normal expansion plug of known technique for the hole close to the other end, so that on adjustment of the expansion plug according to the invention the runner slants, rotating around the other expansion plug.

The runner can also be provided with a countersunk hole 28 in which to place a conventional fastening screw. Once the adjustment has been carried out, said screw can be tightened to lock the runner securely in the desired final position.

The foregoing description of embodiments applying the innovative principles of this invention is obviously given by way of example in order to illustrate such innovative principles and should not therefore be understood as a limitation to the sphere of the invention claimed herein. For example, the second segment of the pin can be omitted and the rectilinear movement effect of the head can be provided by the combined action of the first segment and the detent 19, 119, sliding along the vertical groove and which forms means for guiding the movement of the head of the pin crosswise to its axis.

Moreover, the pin can be secured in the housing in a way different from the one shown or can be omitted completely whenever the expansion plug serves only for adjustment and not for fastening.

What is claimed is:

1. An expansion plug fastening assembly for fastening a hardware element, in particular a runner for drawers, to a hole in a surface, comprising an expansion plug casing which fits into the hole, the casing internally comprising an axial housing rotatably supporting therein the shank of a pin, said pin having a head facing out from the housing for fastening engagement with the hardware element, and means for guiding the head in a direction transverse to the axis of said pin, including at least a first segment of the shank having an axis eccentric with respect to said head to effect adjustment of the position of the hardware element in a plane perpendicular to the axis of the pin upon rotation of the pin; and characterized by the fact that the shank comprises a second segment coaxial to the head, the housing comprises a first portion which receives the first segment and a second portion which receives the second segment, the first portion being extended in a first direction radial to the casing of the expansion plug and the second portion being extended in a second direction radial to the casing of the expansion plug and perpendicular to the first direction, whereby upon rotation of the pin each segment moves in the direction of extension of the respective portion of the housing.

2. Assembly as claimed in claim 1, characterized by the fact that at least the second portion of the housing which receives the segment of the pin coaxial to the head is rectilinearly extended in order to permit, upon rotation of the pin, the movement of the head according to a rectilinear path.

3. Assembly as claimed in claim 1, characterized by the fact that the first and second segment have circular cross-sections, the first segment being inscribed with its cross-section within the cross-section of the second segment and tangent thereto, the first portion of the housing having a cross-section inscribed within the cross-section of the second portion of housing and a major crosswise dimension substantially identical to the minor crosswise dimension of the second portion.

4. Assembly as claimed in claim 1, characterized by the fact that the second segment is between the head of the pin and the first segment.

5. Assembly as claimed in claim 1, chracterized by the fact that the housing is formed by an opening through the casing of the expansion plug, the pin having a tail end facing out from the housing at the opposite end to the head and having secured thereon a lock washer to prevent the pin from slipping out of the housing.

6. Assembly as claimed in claim 1, characterized by the fact that the expansion plug casing has thereon a detent capable of protruding into a recess in said element adjacent the head of the pin to constitute a restraint to prevent axial rotation of the expansion plug casing with respect to the hardware element.

7. Assembly as claimed in claim 1, characterized by the fact that the expansion plug casing has therein an annular slot around and parallel to the pin housing, the slot opening out at the end of the expansion plug opposite the head of the pin.

* * * * *